United States Patent [19]

Flosi et al.

[11] Patent Number: 4,694,505

[45] Date of Patent: Sep. 22, 1987

[54] UPPER BODY PROTECTOR FOR OFF-ROAD RIDERS

[76] Inventors: Corrado Flosi, Via Rosselli 8, S. Romano (Ri); Alberto Gobbi, Vie Anadeo 24, Milano; Roberto Maccioni, Via Vittor Pisani 37, Vi Reggio; Guerrieri Simonetta, Via Rosselli 8, S. Romano, all of Italy

[21] Appl. No.: 595,404

[22] Filed: Mar. 30, 1984

[51] Int. Cl.[4] ..... A41D 13/00

[52] U.S. Cl. ..... 2/2

[58] Field of Search ..... 2/2, 2.5

[56] References Cited

U.S. PATENT DOCUMENTS

| | | | |
|---|---|---|---|
| 1,136,307 | 4/1915 | Bourdon | 2/2 |
| 2,953,789 | 9/1960 | Morgan et al. | 2/2 |
| 3,500,472 | 3/1970 | Castellani | 2/2 |
| 4,317,237 | 3/1982 | Porte | 2/2 |
| 4,467,475 | 8/1984 | Gregory et al. | 2/2 |
| 4,590,621 | 5/1986 | Flosi et al. | 2/2 |

*Primary Examiner*—Louis K. Rimrodt

*Attorney, Agent, or Firm*—Ralph S. Branscomb

[57] ABSTRACT

An upper body protector is provided primarily for use by off-road racers and is comprised of a substantially rigid louvered polypropylene exoskeleton with a padded lining. Rather than comprising in essence a front and rear body shield held together by shoulder straps, this protector has a shoulder cover that extends completely over the shoulders forwardly and rearwardly to protect the deltoid muscles and the clavicle. The remaining structure of the protector connects to the shoulder cover and includes a lengthwise adjustably connected ventral shield, a dorsal shield, a pair of epaulet pivotally attached over the shoulder articulations and being stopped from pivoting into the neck by a pair of raised ribs defined in the shoulder cover along side the neck opening. Arm protection includes an upper arm cover strapped to the respective epaulet, and a combined elbow/lower arm protector comprising a rigid elbow cup and lower arm trough integrally molded as a single piece but articulately connected by virtue of a pair of plastic strands connecting the elbow cup and trough.

6 Claims, 13 Drawing Figures

FIG. 7
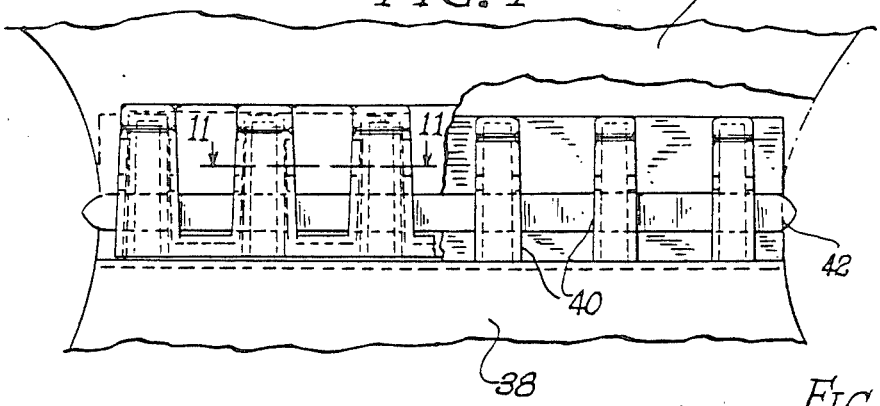
FIG. 8
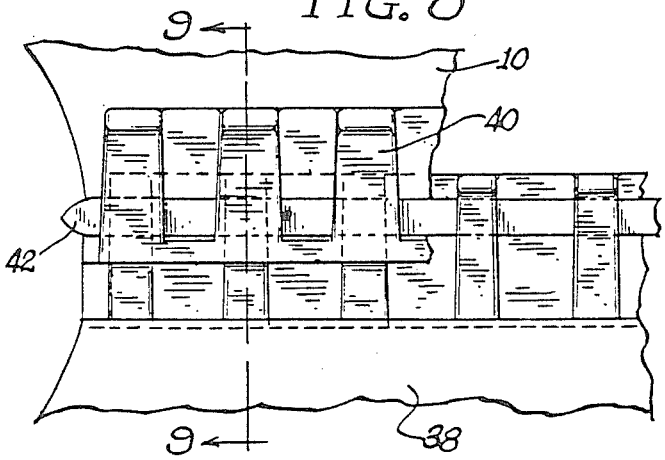
FIG. 9
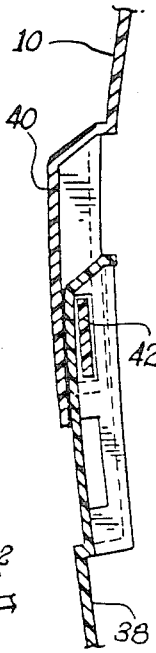
FIG. 10
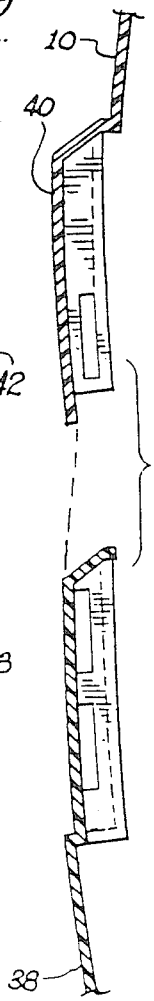
FIG. 11
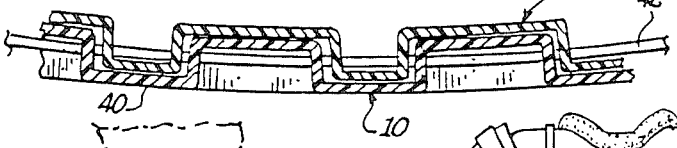
FIG. 12
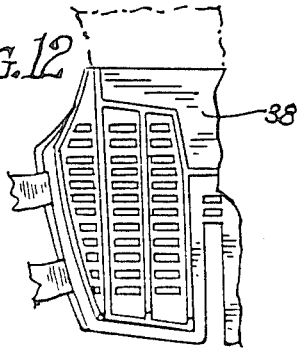
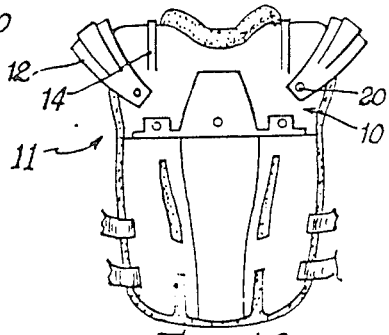
FIG. 13

UPPER BODY PROTECTOR FOR OFF-ROAD RIDERS

BACKGROUND OF THE INVENTION

The invention is in the fast-moving field of motocross and off-road racing, and more specifically pertains to the fast-moving protective clothing and accessory industry which has grown along with the sport. Originally comprised of modified hockey equipment when motocross was young, off-road protective equipment now defines its own, sophisticated industry.

Off-road racers need body protection for a number of different areas of the body. Protective equipment designed for the torso and arms must meet certain specifications in order to be acceptable to the sport. It must protect the internal organs, joints, muscles and bones from injury during the inevitable crashes and accidents that take place. Additionally, during a typical motocross race, stones are thrown by forward motorcycles against riders coming up from the rear. The ventral shield must be adequate to protect the rider from these stones. Protection against abrasion and tearing injuries must also be provided.

In addition to these basic requirements of protection, proper equipment must also permit the rider to perspire freely, it must not impede complete articulation at all joints, and it must be lightweight, sturdy, and easily removable in the event a rider is injured and must be quickly medically treated after an accident.

Vests and other protective clothing made of fabric with strategically positioned plastic plates are only slightly protective and leave dangerous voids between the plastic parts. On the other hand, vests made entirely of plastic are too rigid and awkward. The state of the art in the making of vests and other protective torso equipment therefor combines large, louvered plastic panels to cover, for example, the dorsal area, back, and arms of the rider, with a fabric lining or padding which also defines articulations between certain of the plastic parts. However, vests and other protectors have been subjected to detailed technical and ergonomic study to discover any weaknesses in the existing equipment and to enable the construction of the improved equipment detailed in this disclosure.

Typically, torso protective equipment has grown as an extension of the concept of a protective vest. Therefore, a typical torso protector comprises a vest to protect the ventral regions of the body, and a similar piece covering the dorsal areas of the torso, with the two pieces being connected together by straps over the shoulders, with there possibly being individual protectors over each shoulder.

The trouble with this design resides in the fact that insufficient protection is given to the clavicular articulation and the deltoidal muscles, and large pectoral muscles as well. This design provides excessive flexibility in the shoulder regions and insufficient resistance to crushing forces applied in the shoulder region. Additionally, in some designs there is an inherent danger to the neck from epaulettes being forced into the neck if the epaulettes are of the pivotal variety. At least one death is known to have occurred when a pivotal epaulette jammed into the rider's neck in an accident.

Other shortcomings of current designs typically include the absence of size adjustability at least for the vest portion, the absence of protection for the lower abdominal regions of the body, and the absence of arm protection that extends all the way to the end of the forearm, which is a region of the body which takes considerable abrasion and abuse during falls. The most significant shortcoming of the prior art, however, is the absence of a rigid, reinforced over-the-shoulder member which has the helmet-like capacity to distribute shock relatively evenly throughout the upper body during an accident.

SUMMARY OF THE INVENTION

The upper body protector of the instant disclosure is the result of a study by a team composed of designers, doctors, technicians, and motocross riders, focusing on the ergonomics of torso and arm protection during riding, the requirements of an ideal upper body protector, and a study of the equipment used for this purpose currently on the market.

The exchange of ideas and experiences between the various parties who inputted into the final design of the instant torso protector resulted in the creation of a piece of protective equipment that is rigid but is also adjustable to different sizes. It is durable, but also extremely lightweight and ventilated and padded in the optimal way to improve wearability.

The basic construction is of large, polypropylene panels which define a series of parallel strengthening ribs separated by louvered panels to permit ventilation. This construction optimizes the competing requirements of strength, lightness of weight, and ventilation. More specifically, at the core of the protector is a shoulder cover which passes completely over the shoulders from front to back. In the preferred embodiment, the shoulder cover passes from about mid-back to about midway down the pectorals. This maximizes the protection of the deltoid muscles over the shoulder articulations and the clavicular articulation. The pectoral muscles are also protected. The shoulder cover is further reinforced by two large ribs alongside the neck opening which pass completely over the top, curved portion of the shoulders.

Additionally, an epaulet is provided over each shoulder, and is pivoted at its foremost and rearmost points to the shoulder cover to accommodate moving the arm up and down. The epaulettes cooperate with the abovementioned large ribs defined in the shoulder cover alongside the neck opening in that the ribs provide a positive stop for the epaulettes so that there is no danger that they will be jammed into the neck of the rider. This enables the epaulets to be invested with the maximum possible rotation capability, while eliminating any chance that they will contribute to neck injury.

A further major improvement is provided in the ventral portion of the protector, which is connected to the lower ventral edge of the shoulder cover. The ventral shield actually can be adjusted to extend downward further on the wearer's body to accommodate a rider who has grown in height, as well as accommodating different riding conditions and styles.

Further, whereas prior art vests stop around the navel, the instant protector includes a lower abdominal shield which in the preferred embodiment is releasably and hingedly connected to the lower end of the ventral shield. This protects the soft organs of the abdomen against being gouged by a handlebar or the like, and yet is articulated so that it does not interfere with the natural movements of the rider's body.

To protect the arms, the invention goes beyond an upper arm protector, and actually includes a forearm and elbow protector which is strapped to the upper arm protector, which is in turn strapped to the respective epaulette. The forearm and elbow protectors are removable, so that the rider need not wear them unless he is in stiff competition or riding in rugged country.

BRIEF DESCRIPTION OF THE DRAWINGS

FIG. 7 is a front elevation view of the adjustable connector between the lower edge of the shoulder cover and the top of the ventral shield;

FIG. 8 is a view similar to FIG. 7 but with portions cut away;

FIG. 9 is a section through the connector of FIGS. 7 and 8 showing the ventral shield in its lowered position;

FIG. 10 illustrates the ventral shields separated completely from the shoulder cover;

FIG. 11 is a section taken through line 11—11 of FIG. 7; and,

FIG. 12 illustrates a portion of the front of the ventral shield showing the cut-out pattern;

FIG. 13 is a somewhat diagrammatic rear elevation view of the protector.

DETAILED DESCRIPTION OF THE PREFERRED EMBODIMENT

Figure 1:
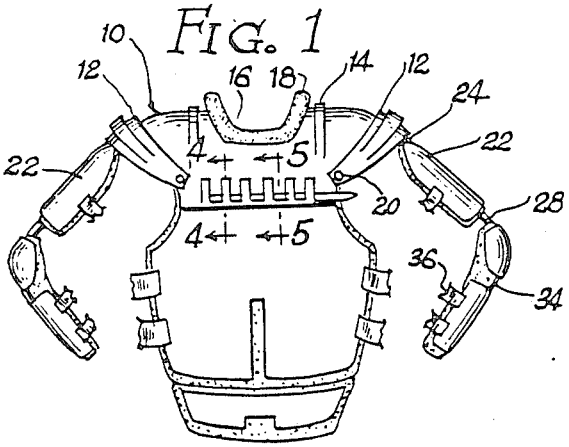
FIG. 1 is a front elevation view of the protector of the instant invention.
Figure 2:
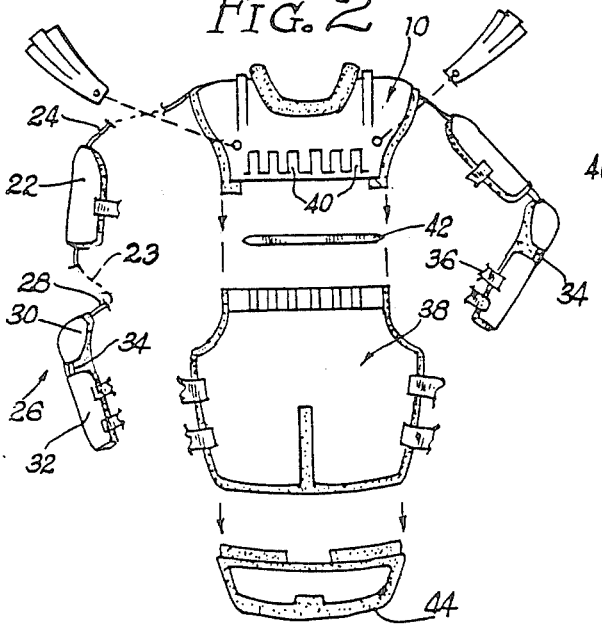
FIG. 2 is a view of FIG. 1 but with certain parts exploded.
Figure 4:
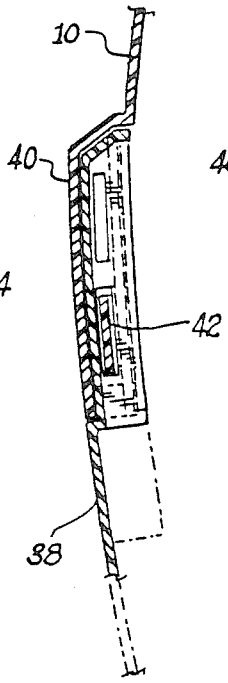
FIG. 4 is a section taken along line 4—4 of FIG. 1.
Figure 5:
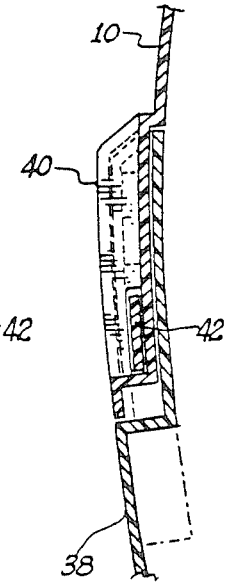
FIG. 5 is a section taken along line 5—5 of FIG. 1.

The protector is shown more or less in its entirety in FIG. 1. The central, most basic piece of the unit is the shoulder cover 10. Instead of merely acting as a support for front and rear shields, the cover 10 is rigid and extends all the way from mid-back, where it is riveted to the dorsal shield 11 as shown in FIG. 13, to the upper portion of the pects as shown in FIG. 2. The shoulders are thus very well protected. In fact, the shoulder cover in the preferred embodiment extends down far enough that as an option one might omit the appended dorsal shield altogether.

To strengthen the shoulder cover and also to act as a stop for the epaulettes 12, two ribs 14 are defined in the polypropylene plastic of which the shoulder cover 10 is made. These ribs lie just outside the neck opening 60. Padding is shown at 18 for the neck opening, and although lining and padding occurs elsewhere on the inside of the protector, it has been omitted from the drawings for simplicity and because it does not define novel structure.

Figure 3:
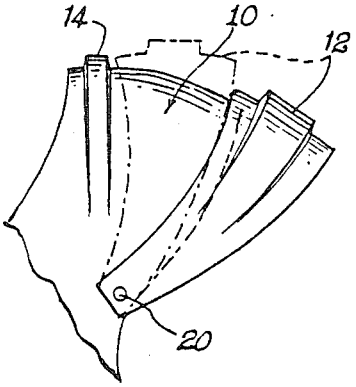
FIG. 3 is a detail of a shoulder illustrating the articulation of the epaulette and its position vis-a-vis the shoulder rib.

In order to permit the arms to move up and down completely freely, the articulation at the shoulder is covered by an epaulette 12 on each shoulder. The epaulettes are connected to the shoulder cover by pivotal points 20 at the foremost and rearmost point at the epaulette. This permits the epaulette to pivot as shown in FIG. 3, as it must do when the arm is raised. As shown in FIG. 3, the ribs 14 serve the very important function of backstopping the epaulettes 12. Although in ordinary use this would not be required, a properly delivered sharp blow received during an accident could conceivably force the epaulette into the neck with potentially disastrous results.

To protect the entire arm, and yet at the same time not impede the articulations, an upper arm guard 22 is held onto the forearm by straps 23 and is connected to the shoulder cover by means of a strap 24. This strap also connects to the epaulette in its central portion so that when the arm is lowered after it has been raised, the epaulette is pulled down into place and the entire arm guard structure acts as a unit.

By the same token, the elbow/forearm guard 26 connects to the upper arm guard 22 by virtue of another strap 28. This strap snaps inside the lower edge of the upper arm guard and is easily removable in the event that the rider does not wish to wear the elbow/forearm guards.

The elbow/forearm guards are of a very particular construction. The rigid exoskeleton consists of an elbow cup 30 and a lower trough-like plastic segment 32 for the forearm. The elbow cup and the forearm trough are connected by means of a pair of thin webs 34 which act as a hinge, although they are strong enough to firmly hold the two pieces together. The inside of the elbow/-forearm protector is lined with a shock absorbing layer of foam, and like the upper arm protector, is held onto the forearm by means of straps 36.

Thus, the arms are protected all the way from the shoulder down to near the wrists, with lightweight, ventilated guards that do not interfere with the movement of the shoulder joint, or the elbow.

Turning now to the ventral portion of the suit, the lower ventral edge of the shoulder cover connects to the ventral shield 38 in a simple fashion that is most easily understood by reference to FIG. 11. Both members at their meeting edge are provided with with generally box-shaped protrusions 40 which nest together as can be seen in FIG. 11. The sidewalls of these protrusions are perforated in rows, so that two rows of aligned holes or perforations are defined in the ventral cover, and one row is defined on the shoulder cover, which overlies the ventral shield. A key 42 passes through the perforations as shown in FIG. 11 to provide a very secure, rigid connection between the two members. In order to extend the ventral shield down further, the upper row appropriations and the ventral shield are engaged as shown in FIG. 9. For purposes of illustration, FIG. 10 illustrates the two members completely separated, although obviously this would not represent an optional way of wearing the unit in the ordinary course of events.

Figure 6:
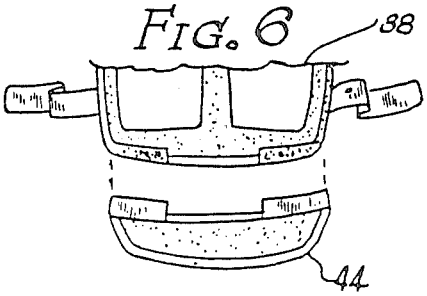
FIG. 6 is an enlarged view of the abdominal protector removed from the lower edge of the ventral shield.

In addition to the adjustability of the ventral shields, there is a need to cover the lower abdomen which has not been met by currently marketed upper body protectors, and is met in the instant invention by means of the lower abdominal shield 44. This member, shown in FIGS. 2 and 6, is preferably removable and articulately engaged at the lower edge of the ventral shield. The connection in the preferred embodiment is made with hook-and-loop fasteners (Velcro TM) which effects both the removability and the articulation. The abdominal shield is attached close to the ventral shield so that no penetrable area of any extent is defined between the two.

A few of the ribs and louvres are shown in FIG. 2. However, although these are the state of the art, they are not new to this protector and thus are not repetitiously shown throughout all the drawings. It should be noted that every piece of the protector is provided with louvres and ribs, and every piece but the lower abdominal shield has some louvres defined in the polypropylene which are not covered by lining or padding on the inside to permit free ventilation of all parts of the body. The combination of skillfully designed louvers and ribs maximizes strength and ventilation while minimizing weight.

Thus, an upper body protector is provided for the off-road crowd which establishes the state of the art, and which has been designed to truly meet the needs of riders, after an unusually careful and thorough investigation into those needs has been made. The design was not the result of the thinking of riders alone or manufacturers alone, or even physicians alone. Rather, it represents the integration of creative input from physicians, riders, racing experts, and manufacturing experts, to produce what is probably the safest, toughest, well-thought-out upper body protector on the market today.

While the preferred embodiment of the invention has been described, other modifications may be made thereto and other embodiments may be devised within the spirit of the invention and the scope of the appended claims.

We claim:

1. An upper body protector comprising:

(a) a unitary, at least semi-rigid shoulder cover extending completely over the shoulder from the dorsal side of the body to the ventral side thereof and defining a neck opening;

(b) a ventral shield extending down from the front of said cover to shield the chest;

(c) means for holding the ventral shield against the body;

(d) a pair of epaulets arching dorsally-to-ventrally over the shoulder articulations and being mounted to said shoulder cover;

(e) said epaulets being pivotally mounted at their dorsal and ventral extremes to said cover to pivot toward and away from the neck opening of said shoulder; and, (f) including a raised rib on each side of said neck opening on said shoulder cover positioned and dimensioned to act as a stop to prevent inward motion of said epaulets toward the neck beyond a predetermined point.

2. Structure according to 1 and including an upper arm shield connected to said shoulder cover with a strap, and an elbow and forearm shield connected to said upper arm shield by a strap.

3. Structure according to claim 2 wherein said elbow and forearm guards each comprise a rigid elbow cover articulately connected to a rigid forearm protector.

4. Structure according to claim 1 wherein said raised ribs on said shoulder cover define dorsal-to-ventrally oriented reinforcing ribs on each side of said neck opening.

5. Structure according to claim 1 and including a pair of unitary elbow and forearm guards connected to said shoulder cover.

6. Structure according to claim 1 and including a dorsal shield depending from the lower dorsal edge of said shoulder cover.

* * * * *